US008232884B2

(12) United States Patent
Pattok et al.

(10) Patent No.: US 8,232,884 B2
(45) Date of Patent: Jul. 31, 2012

(54) CARBON MONOXIDE AND SMOKE DETECTORS HAVING DISTINCT ALARM INDICATIONS AND A TEST BUTTON THAT INDICATES IMPROPER OPERATION

(75) Inventors: Greg R. Pattok, Holland, MI (US); Richard T. Fish, Jr., Jenison, MI (US); Scott R. Edwards, Alto, MI (US); Darin D. Tuttle, Byron Center, MI (US); Christopher D. Stirling, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 556 days.

(21) Appl. No.: 12/429,646

(22) Filed: Apr. 24, 2009

(65) Prior Publication Data

US 2010/0271220 A1 Oct. 28, 2010

(51) Int. Cl.
*G08B 21/00* (2006.01)

(52) U.S. Cl. ..... 340/628; 340/539.26; 340/632; 340/693.6

(58) Field of Classification Search ..... 340/628, 340/629, 630, 693.6, 531, 532, 539.26, 577, 340/632, 691.1–691.6
See application file for complete search history.

(56) References Cited

U.S. PATENT DOCUMENTS

| | | | |
|---|---|---|---|
| 3,312,826 | A | 4/1967 | Finkle |
| 3,665,461 | A | 5/1972 | Gnägi et al. |
| 3,765,842 | A | 10/1973 | Purt |
| 3,801,972 | A | 4/1974 | Kim et al. |
| 3,868,184 | A | 2/1975 | Marsocci |
| 3,872,355 | A | 3/1975 | Klein et al. |
| 4,004,288 | A | 1/1977 | Webb, Jr. |
| 4,080,568 | A | 3/1978 | Funk |
| 4,101,880 | A | 7/1978 | Haus |
| 4,114,089 | A | 9/1978 | Ahmed |

(Continued)

FOREIGN PATENT DOCUMENTS

DE 10147103 4/2003

OTHER PUBLICATIONS

Daniel T. Gottuk, Michelle J. Peatross, Richard J. Roby, Craig L. Beyler, Advanced Fire Detection Using Multi-Signature Alarm Algorithms, Reprinted from the Fire Suppression and Detection Research Applications Symposium. Research and Practice: Bridging the Gap. Proceedings. Nation Fire Protrection Research Foundation. Feb. 24-26, 1999 Orlando, FL, 140-149 pp.

*Primary Examiner* — Jeffery Hofsass
(74) *Attorney, Agent, or Firm* — Price Heneveld LLP; Scott P. Ryan

(57) ABSTRACT

A detection device and detection device system are provided, wherein the detection device includes a housing, a first detector device and a second detector device. The first detector device is configured to detect at least one smoke particle. A second detector device configured to detect at least one gas particle, wherein the first detector device and the second detector device are substantially enclosed in the housing. The detection device further includes an audible enunciator configured to emit an audible noise when at least one of the first and second detector devices detect at least one smoke and gas particle, and a test button, wherein the audible enunciator emits an audible sound when the detection device is operating improperly and the test button is activated.

28 Claims, 7 Drawing Sheets

U.S. PATENT DOCUMENTS

| | | | |
|---|---|---|---|
| 4,163,226 | A | 7/1979 | Ogawa |
| 4,180,803 | A | 12/1979 | Wesemeyer et al. |
| 4,247,848 | A | 1/1981 | Kitta et al. |
| 4,274,084 | A | 6/1981 | Haus |
| 4,297,688 | A | 10/1981 | Kakigi |
| 4,363,031 | A | 12/1982 | Reinowitz |
| 4,432,041 | A | 2/1984 | Pfisterer et al. |
| 4,499,453 | A | 2/1985 | Right |
| 4,511,889 | A | 4/1985 | Atwater |
| 4,594,573 | A | 6/1986 | Yoshino et al. |
| 4,733,224 | A | 3/1988 | Kimura |
| 4,734,680 | A | 3/1988 | Gehman et al. |
| 4,742,328 | A | 5/1988 | Arai et al. |
| 4,792,797 | A | 12/1988 | Tanguay et al. |
| 4,839,527 | A | 6/1989 | Leitch |
| 4,870,395 | A | 9/1989 | Belano |
| 4,900,990 | A | 2/1990 | Sikora |
| D308,947 | S | 7/1990 | Downing |
| 4,951,081 | A | 8/1990 | Hosomizu et al. |
| 4,952,906 | A | 8/1990 | Buyak et al. |
| 4,965,556 | A | 10/1990 | Brodecki et al. |
| 5,019,805 | A | 5/1991 | Curl et al. |
| 5,078,039 | A | 1/1992 | Tulk et al. |
| RE33,920 | E | 5/1992 | Tanguay et al. |
| 5,121,033 | A | 6/1992 | Kosich |
| 5,213,513 | A | 5/1993 | Brown et al. |
| 5,386,209 | A | 1/1995 | Thomas |
| 5,486,811 | A | 1/1996 | Wehrle et al. |
| 5,525,962 | A | 6/1996 | Tice |
| 5,559,492 | A | 9/1996 | Stewart et al. |
| 5,563,578 | A | 10/1996 | Isenstein |
| 5,570,077 | A | 10/1996 | Swieboda |
| 5,587,705 | A | 12/1996 | Morris |
| 5,592,147 | A | 1/1997 | Wong |
| 5,622,427 | A | 4/1997 | Lemons et al. |
| 5,627,515 | A | 5/1997 | Anderson |
| 5,691,703 | A | 11/1997 | Roby et al. |
| 5,705,979 | A | 1/1998 | Fierro et al. |
| 5,708,414 | A | 1/1998 | Peltier et al. |
| D390,797 | S | 2/1998 | Yao et al. |
| 5,777,551 | A | 7/1998 | Hess |
| 5,801,633 | A | 9/1998 | Soni |
| 5,803,579 | A | 9/1998 | Turnbull et al. |
| 5,850,180 | A | 12/1998 | Hess |
| 5,886,638 | A | 3/1999 | Tanguay |
| 5,896,091 | A | 4/1999 | Soderlund |
| 5,898,369 | A | 4/1999 | Godwin |
| 5,912,626 | A | 6/1999 | Soderlund |
| 5,933,078 | A | 8/1999 | O'Donnell |
| 5,966,078 | A | 10/1999 | Tanguay |
| 5,966,079 | A | 10/1999 | Tanguay |
| 5,969,600 | A | 10/1999 | Tanguay |
| 5,973,603 | A | 10/1999 | Judy |
| 6,002,347 | A | 12/1999 | Daly et al. |
| 6,027,693 | A | 2/2000 | Molina et al. |
| 6,078,269 | A | 6/2000 | Markwell et al. |
| 6,107,925 | A | 8/2000 | Wong |
| 6,110,038 | A | 8/2000 | Stern |
| 6,121,874 | A | 9/2000 | O'Donnell |
| 6,144,310 | A | 11/2000 | Morris |
| 6,217,196 | B1 | 4/2001 | Kosich et al. |
| 6,225,910 | B1 | 5/2001 | Kadwell et al. |
| 6,229,429 | B1 | 5/2001 | Horon |
| 6,243,001 | B1 | 6/2001 | Kodaka |
| 6,297,610 | B1 | 10/2001 | Bauer et al. |
| 6,311,021 | B1 | 10/2001 | Kosich |
| 6,313,744 | B1 | 11/2001 | Capowski et al. |
| 6,326,897 | B2 | 12/2001 | Kadwell et al. |
| 6,348,871 | B1 | 2/2002 | Tanguay et al. |
| 6,351,219 | B1 | 2/2002 | Tanguay et al. |
| 6,353,395 | B1 | 3/2002 | Duran |
| 6,362,743 | B1 | 3/2002 | Tanguay et al. |
| 6,377,182 | B1 | 4/2002 | Devine et al. |
| 6,384,723 | B1 | 5/2002 | Keeler et al. |
| 6,411,201 | B1 | 6/2002 | Hur et al. |
| 6,426,691 | B1 | 7/2002 | Kido |
| 6,426,697 | B1 | 7/2002 | Capowski et al. |
| 6,483,254 | B2 | 11/2002 | Vo et al. |
| 6,498,440 | B2 | 12/2002 | Stam et al. |
| 6,522,248 | B1 | 2/2003 | Gilbert et al. |
| 6,556,132 | B1 | 4/2003 | Pattok et al. |
| RE38,183 | E | 7/2003 | Kosich et al. |
| 6,600,424 | B1 | 7/2003 | Morris |
| 6,611,204 | B2 | 8/2003 | Schmurr |
| 6,614,347 | B2 | 9/2003 | Tanguay |
| 6,646,566 | B1 | 11/2003 | Tanguay |
| 6,653,942 | B2 | 11/2003 | Kadwell et al. |
| 6,680,834 | B2 | 1/2004 | Williams |
| 6,693,529 | B2 | 2/2004 | Suzuki et al. |
| 6,693,532 | B2 | 2/2004 | Capowski et al. |
| 6,720,881 | B1 | 4/2004 | Halliday |
| 6,720,883 | B2 | 4/2004 | Kuhr et al. |
| 6,753,786 | B1 | 6/2004 | Apperson et al. |
| 6,762,688 | B2 | 7/2004 | Johnston et al. |
| 6,778,082 | B2 | 8/2004 | Goodwin |
| 6,788,197 | B1 | 9/2004 | Thuillard et al. |
| 6,791,453 | B1 | 9/2004 | Andres et al. |
| 6,793,375 | B2 | 9/2004 | Anderson |
| 6,816,068 | B2 | 11/2004 | McCuen et al. |
| 6,816,069 | B2 | 11/2004 | Quigley |
| 6,819,252 | B2 | 11/2004 | Johnston et al. |
| 6,839,636 | B1 | 1/2005 | Sunshine et al. |
| 6,876,305 | B2 | 4/2005 | Kadwell et al. |
| 6,879,263 | B2 | 4/2005 | Pederson et al. |
| 6,888,322 | B2 | 5/2005 | Dowling et al. |
| 6,897,624 | B2 | 5/2005 | Lys et al. |
| 6,914,534 | B2 * | 7/2005 | Tanguay ..... 340/628 |
| 6,954,137 | B2 | 10/2005 | Stewart et al. |
| 6,958,689 | B2 | 10/2005 | Anderson et al. |
| 6,967,582 | B2 | 11/2005 | Tice et al. |
| 6,989,757 | B2 | 1/2006 | Geoffrey et al. |
| 6,998,991 | B1 | 2/2006 | Goldstein et al. |
| 7,005,971 | B2 | 2/2006 | Stewart et al. |
| 7,005,994 | B2 | 2/2006 | King |
| 7,006,003 | B2 | 2/2006 | Zimmerman et al. |
| 7,057,517 | B1 | 6/2006 | Convery |
| 7,079,020 | B2 | 7/2006 | Stilp |
| 7,103,511 | B2 | 9/2006 | Petite |
| 7,109,874 | B2 | 9/2006 | Pilkington |
| 7,126,467 | B2 | 10/2006 | Albert et al. |
| 7,126,487 | B2 | 10/2006 | Kaiser et al. |
| 7,129,833 | B2 | 10/2006 | Albert |
| 7,142,105 | B2 | 11/2006 | Chen |
| 7,148,797 | B2 | 12/2006 | Albert |
| 7,158,023 | B2 | 1/2007 | Kaiser |
| 7,158,040 | B2 | 1/2007 | Morris |
| 7,167,099 | B2 | 1/2007 | Kadwell et al. |
| D536,274 | S | 2/2007 | Rosenblatt |
| 7,173,525 | B2 | 2/2007 | Albert |
| 7,186,979 | B1 | 3/2007 | Wong |
| 7,198,387 | B1 | 4/2007 | Gloisten et al. |
| 7,214,939 | B1 | 5/2007 | Wong |
| 7,227,463 | B2 | 6/2007 | Merrell |
| 7,233,781 | B2 | 6/2007 | Hunter et al. |
| 7,242,288 | B2 | 7/2007 | Kaiser et al. |
| 7,245,216 | B2 | 7/2007 | Burkley et al. |
| 7,248,156 | B2 | 7/2007 | Wisniewski et al. |
| 7,262,705 | B2 | 8/2007 | Back et al. |
| 7,298,252 | B1 | 11/2007 | Sutardja et al. |
| 7,301,455 | B2 | 11/2007 | McKenna et al. |
| 7,319,403 | B2 | 1/2008 | Woodard et al. |
| 7,321,783 | B2 | 1/2008 | Kim |
| 7,327,247 | B2 | 2/2008 | Tice |
| 7,333,129 | B2 | 2/2008 | Miller et al. |
| 7,335,885 | B2 | 2/2008 | Wong |
| 7,336,168 | B2 | 2/2008 | Kates |
| 7,337,856 | B2 | 3/2008 | Lund et al. |
| 7,339,468 | B2 | 3/2008 | Andres et al. |
| 7,342,488 | B2 | 3/2008 | Wolfe et al. |
| 7,360,397 | B2 | 4/2008 | Petrovic et al. |
| 7,369,955 | B2 | 5/2008 | Lee |
| 7,372,370 | B2 | 5/2008 | Stults et al. |
| 7,378,954 | B2 | 5/2008 | Wendt |
| 7,382,243 | B1 | 6/2008 | Shepher |
| 7,385,517 | B2 | 6/2008 | Andres et al. |
| 7,400,439 | B2 | 7/2008 | Holman |
| 7,417,540 | B2 | 8/2008 | Johnston et al. |

7,423,544 B2 9/2008 Cartwright et al.
7,449,990 B2 11/2008 Andres et al.
7,679,296 B2 3/2010 Kamatani
2002/0089426 A1* 7/2002 Qualey et al. ..... 340/628
2002/0163438 A1 11/2002 Kuhr et al.
2003/0107495 A1 6/2003 Swieboda et al.
2004/0056765 A1 3/2004 Anderson et al.
2006/0164234 A1 7/2006 Acar
2007/0171044 A1 7/2007 Ollis et al.
2007/0182543 A1 8/2007 Luo
2007/0241875 A1 10/2007 Costa
2007/0279213 A1 12/2007 Cartwright et al.
2007/0285262 A1 12/2007 Lax
2008/0030319 A1 2/2008 McKenna et al.
2008/0055097 A1 3/2008 Chidakel et al.
2008/0117065 A1 5/2008 Lang
2008/0173817 A1 7/2008 Goldstein et al.
2008/0211678 A1 9/2008 Andres et al.
2008/0229831 A1 9/2008 Serban et al.
2009/0072989 A1 3/2009 Rock et al.

* cited by examiner

FIG. 6A
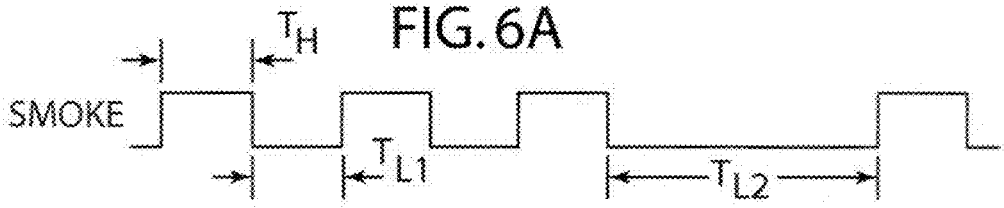
| | |
|---|---|
| $T_H$ | 0.5 SEC |
| $T_{L1}$ | 0.5 SEC |
| $T_{L2}$ | 1.5 SEC |
FIG. 6B
FIG. 7A
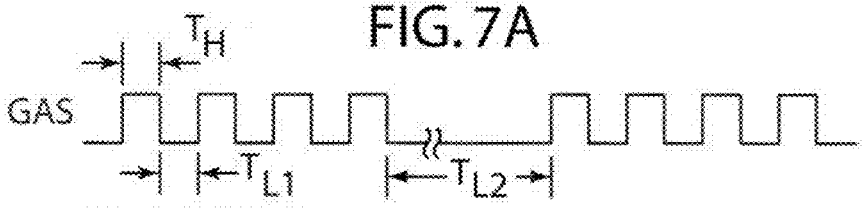
| | |
|---|---|
| $T_H$ | 0.1 SEC |
| $T_{L1}$ | 0.1 SEC |
| $T_{L2}$ | 5.1 SEC |
FIG. 7B
FIG. 8
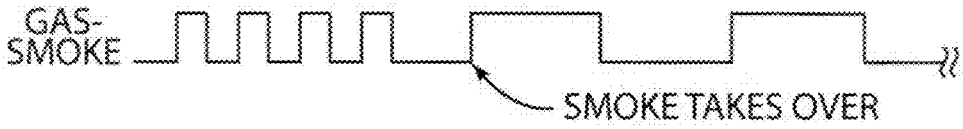

CARBON MONOXIDE AND SMOKE DETECTORS HAVING DISTINCT ALARM INDICATIONS AND A TEST BUTTON THAT INDICATES IMPROPER OPERATION

FIELD OF THE INVENTION

The present invention generally relates to a device for detecting a smoke particle and a gas particle, and more particularly, to a system including a device that detects a smoke particle and a carbon monoxide particle.

BACKGROUND OF THE INVENTION

Generally, smoke detectors detect the presence of smoke particles as an early indication of fire. Smoke detectors are typically used in closed structures such as houses, hotels, motels, dormitory rooms, factories, offices, shops, ships, aircraft, and the like. Smoke detectors may include a chamber that admits a test atmosphere while blocking ambient light. A light receiver within the chamber can receive a level of light from an emitter within the chamber, which light level is indicative of the amount of smoke contained in the test atmosphere.

Several types of fires can generally be detected. A first type is a slow, smoldering fire that produces a "gray" smoke containing generally large particles, which may be in the range of 0.5 to 1.2 microns. A second type is a rapid fire that produces "black" smoke generally having smaller particles, which may be in the range of 0.05 to 0.5 microns. Fires may start as one type and convert to another type depending on factors including fuel, air, confinement, and the like.

Generally, two detector configurations have been developed for detecting smoke particles. One exemplary type of detector is a detector that aligns the emitter and receiver such that light generated by the emitter shines directly into the receiver. Smoke particles in the test atmosphere interrupt a portion of the beam thereby decreasing the amount of light received by the emitter. These detectors can work well for black smoke but are less sensitive to gray smoke. Additionally, such detectors typically are not within a chamber, as they have an emitter and a receiver spaced at a substantial distance, such as one meter or across a room, whereas smoke detector chambers are preferably located within a compact housing. Another exemplary type of detector are indirect or reflected detectors, commonly called scatter detectors, which typically have an emitter and receiver positioned on non-colinear axes, such that light from the emitter does not shine directly onto the receiver. Smoke particles in the test atmosphere reflect or scatter light from the emitter into the receiver.

Smoke detectors typically use solid-state optical receivers such as photodiodes due to their low cost, small size, low power requirements, and ruggedness. One difficulty with solid-state receivers is their sensitivity to temperature. Additional circuitry that increases photoemitter current with increasing temperature partially compensates for temperature effects. Typical detectors also require complicated control electronics to detect the light level including analog amplifiers, filters, comparators, and the like. These components may be expensive if precision is required, may require adjustment when the smoke detector is manufactured, and may exhibit parameter value drift over time.

Further, detection systems, which include several such smoke detectors, typically only detect smoke. Thus, such a detection system generally needs to include additional detectors to detect other particles besides smoke particles. However, the additional detectors typically result in an additional device in the system that has to be mounted on a building structure (e.g., a wall or ceiling) in addition to the smoke detector. Generally, the smoke detector and additional detector are not in communication with each other, such that if both detectors are emitting a noise based upon the detected particle, the emitted noises are emitted independent of one another.

SUMMARY OF THE INVENTION

According to one aspect of the present invention, a detection device includes a housing, a first detector device, and a second detector device. The first detector device is configured to detect at least one smoke particle. The second detector device is configured to detect at least one gas particle, wherein the first detector device and the second detector device are substantially enclosed in the housing. The detection device further includes an audible enunciator configured to emit a first audible sound when the first detector device detects at least one smoke particle, and a second audible sound when the second detector device detects at least one gas particle. Additionally, the detection device includes a test button, wherein the audible enunciator emits a third audible sound when the detection device is operating improperly and the test button is activated, and a receptacle configured to receive a conductor that communicatively connects the detection device with a second detection device, wherein signals corresponding to the first and second audible sounds are communicated to the second detector, while a signal corresponding to the third audible sound is not communicated to the second detector.

According to another aspect of the present invention, a detection device system includes a plurality of detection devices, wherein at least one detection device of the plurality of detection devices includes a housing, a smoke detector device configured to detect a smoke particle, and a carbon monoxide detector device configured to detect a carbon monoxide particle, wherein the smoke detector and carbon monoxide detector are substantially enclosed in the housing. The detection device further includes an audible enunciator configured to emit a first audible tonal pattern when the smoke detector device detects the smoke particle, and emits a second audible tonal pattern when the carbon monoxide detector device detects the carbon monoxide particle. The detection device system further includes a tandem electrical conductor adapted to communicatively connect at least a portion of the plurality of detection devices such that a signal corresponding the smoke detector detecting a smoke particle and the carbon monoxide detector detecting a carbon monoxide particle are communicated over the tandem electrical conductor.

According to yet another aspect of the present invention, a detection device includes a housing, a first detector device, a second detector device, and an indicator device. The first detector device is configured to detect at least one smoke particle and the second detector device is configured to detect at least one gas particle, wherein the first detector device and the second detector device are substantially enclosed in the housing. The indicator device is configured to indicate an operating condition of a detection device, wherein the indicator device at least periodically emits light that is monitored for diagnostics of said operating condition.

BRIEF DESCRIPTION OF THE DRAWINGS

FIG. 6A is a timing diagram illustrating a signal when a detector device detects a smoke particle, and when the detector is configured as a temporal model, in accordance with one embodiment of the present invention;

FIG. 6B is a chart illustrating exemplary time periods with respect to the timing diagram illustrated in FIG. 6A, in accordance with one embodiment of the present invention;

FIG. 7A is a timing diagram illustrating a signal when a detector device detects a gas particle, in accordance with one embodiment of the present invention;

FIG. 7B is a chart illustrating exemplary time periods with respect to the timing diagram illustrated in FIG. 7A, in accordance with one embodiment of the present invention;

FIG. 8 is a timing diagram illustrating a signal when a detector device first detects a gas particle and then detects a smoke particle, in accordance with one embodiment of the present invention;

DETAILED DESCRIPTION OF THE PREFERRED EMBODIMENTS

Figure 1:
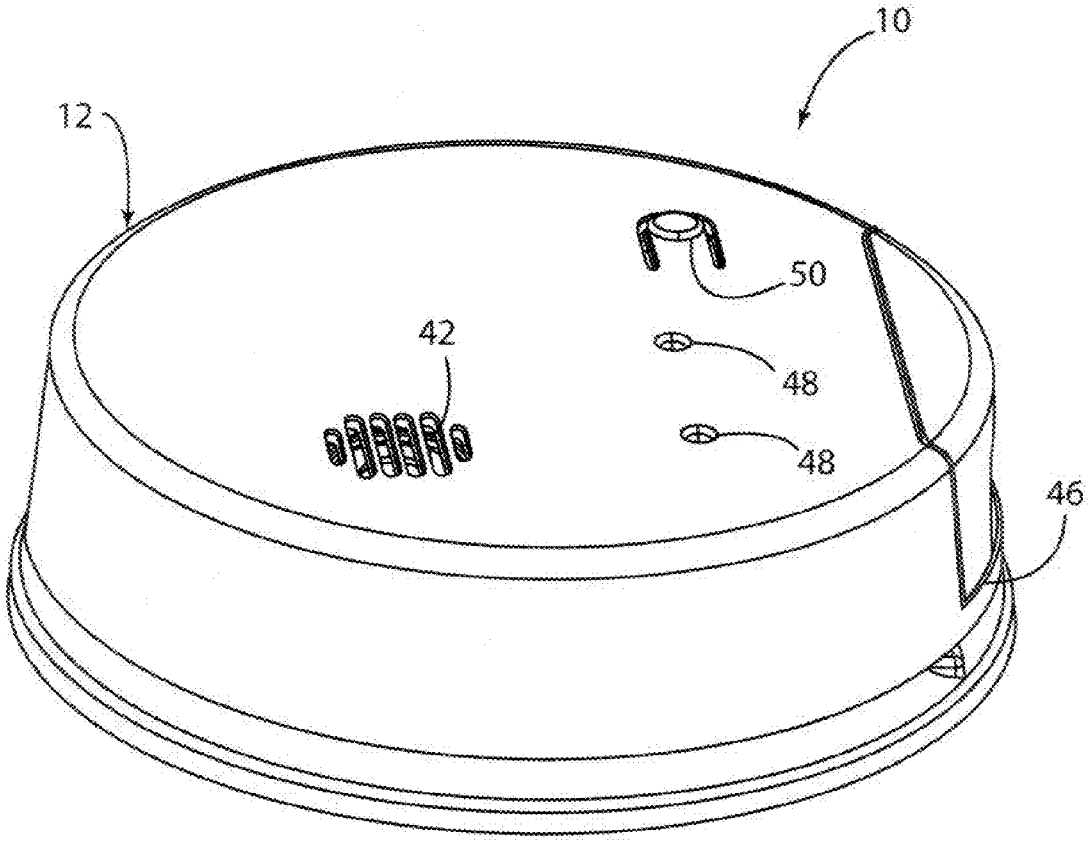
FIG. 1 is a top side perspective view of a detection device, in accordance with one embodiment of the present invention.

Reference will now be made in detail to present preferred embodiments of the invention, examples of which are illustrated in the accompanying drawings. Wherever possible, the same reference numerals will be used throughout the drawings to refer to the same or like parts.

For purposes of description herein, the terms "upper," "lower," "right," "left," "rear," "front," "vertical," "horizontal," "top," "bottom," and derivatives thereof shall relate to the invention as shown in the drawings. However, it is to be understood that the invention may assume various alternative orientations, except where expressly specified to the contrary. It is also to be understood that the specific device illustrated in the attached drawings and described in the following specification is simply an exemplary embodiment of the inventive concepts defined in the appended claims. Hence, specific dimensions, proportions, and other physical characteristics relating to the embodiment disclosed herein are not to be considered as limiting, unless the claims expressly state otherwise.

In regards to FIGS. 1-5, a detection device is generally shown at reference identifier 10. The detection device can include a housing generally indicated at 12, a first detector device 14, and a second detector device 16 (FIGS. 3-5), wherein the first detector device 14 is configured to detect at least one smoke particle, and the second detector device 16 is configured to detect at least one gas particle, according to one embodiment. The first detector device 14, and the second detector device 16 are substantially enclosed in the housing 12, as described in greater detail herein.

Figure 5:
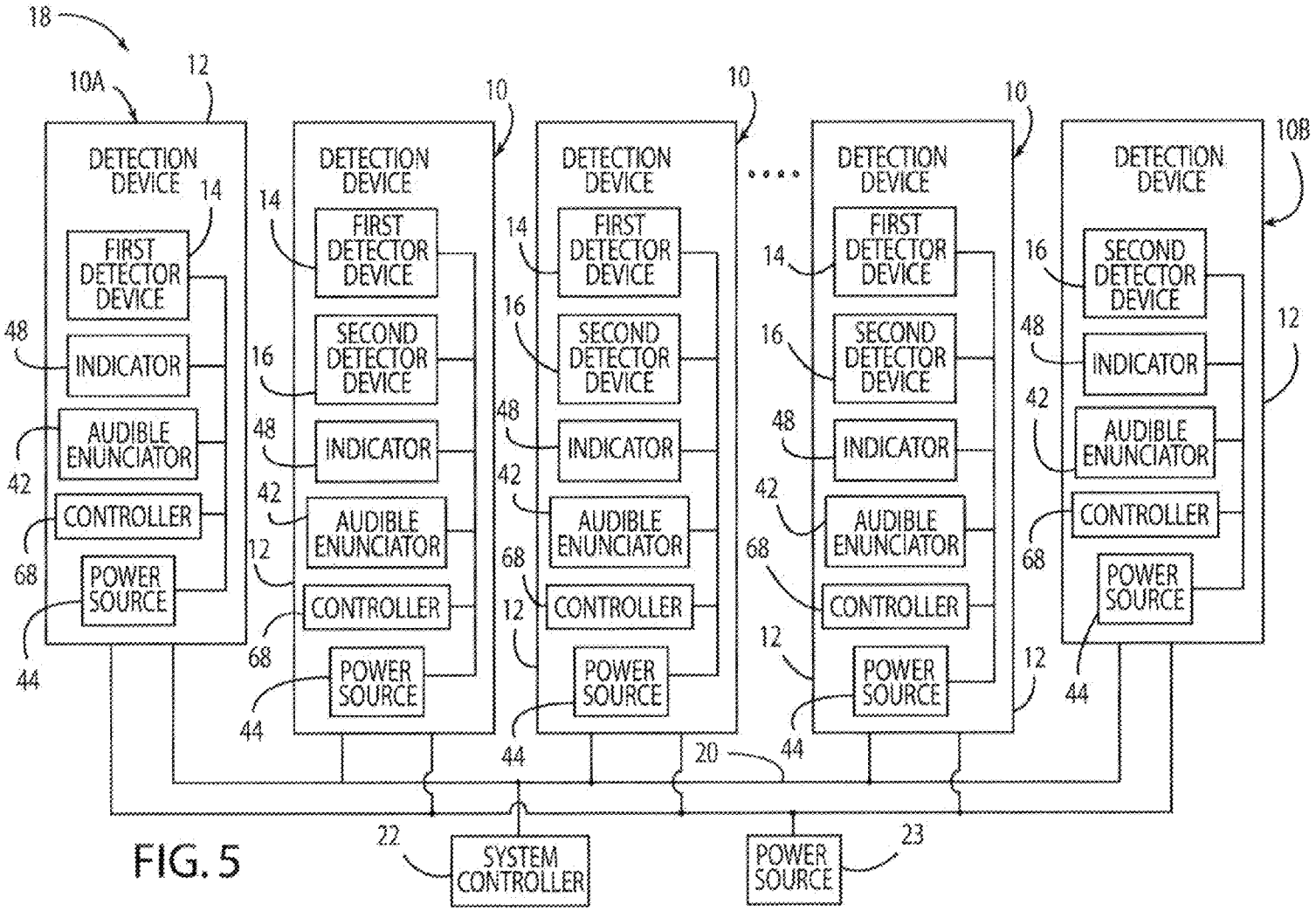
FIG. 5 is a block diagram of a detection device system, in accordance with one embodiment of the present invention.

According to one embodiment, as illustrated in FIG. 5, a plurality of detection devices 10, can be included in a detection device system generally shown at reference identifier 18. It should be appreciated that the detection device system 18 can include any number of detection devices 10, wherein at least a portion of the detection devices 10 included in the detection device system 18 are communicatively connected. According to one embodiment, the communicative connection between the plurality of detection devices 10 is a tandem electrical conductor 20, such as, but not limited to, a single tandem electrical conductor, as described in greater detail below. According to an alternate embodiment, the communicative connection can include multiple electrical conductors, networking electrical conductors (e.g., category 5 (CAT 5) wire), a wireless communication device, the like, or a combination thereof. Thus, the detection device 10 includes, a receptacle configured to receive the conductor for the communicative connection. By communicatively connecting a plurality of detection devices 10 in the detection device system 18, the detection devices 10 can operate with respect to one another, as described in greater detail herein.

The detection device system 18 can further include a system controller 22 in order for controlling at least a portion of the plurality of detection devices 10 included in the detection device system 18. Alternatively, a plurality of detection devices 10 can be communicatively connected without being connected or controlled by a system controller, or a single detection device 10 can be utilized. Additionally or alternatively, the detection device system 18 can include a system power source 23 that supplies electrical power (e.g., one hundred twenty volts (120 V)). The detection device 10 can also be configured to receive or electrically connect to three (3) electrical conductors, such as, but not limited to, a power source electrical conductor (e.g., electrical power supplied from the system power source 23), a ground electrical conductor, and at least one of the tandem electrical conductors 20, according to one embodiment.

Figure 3:
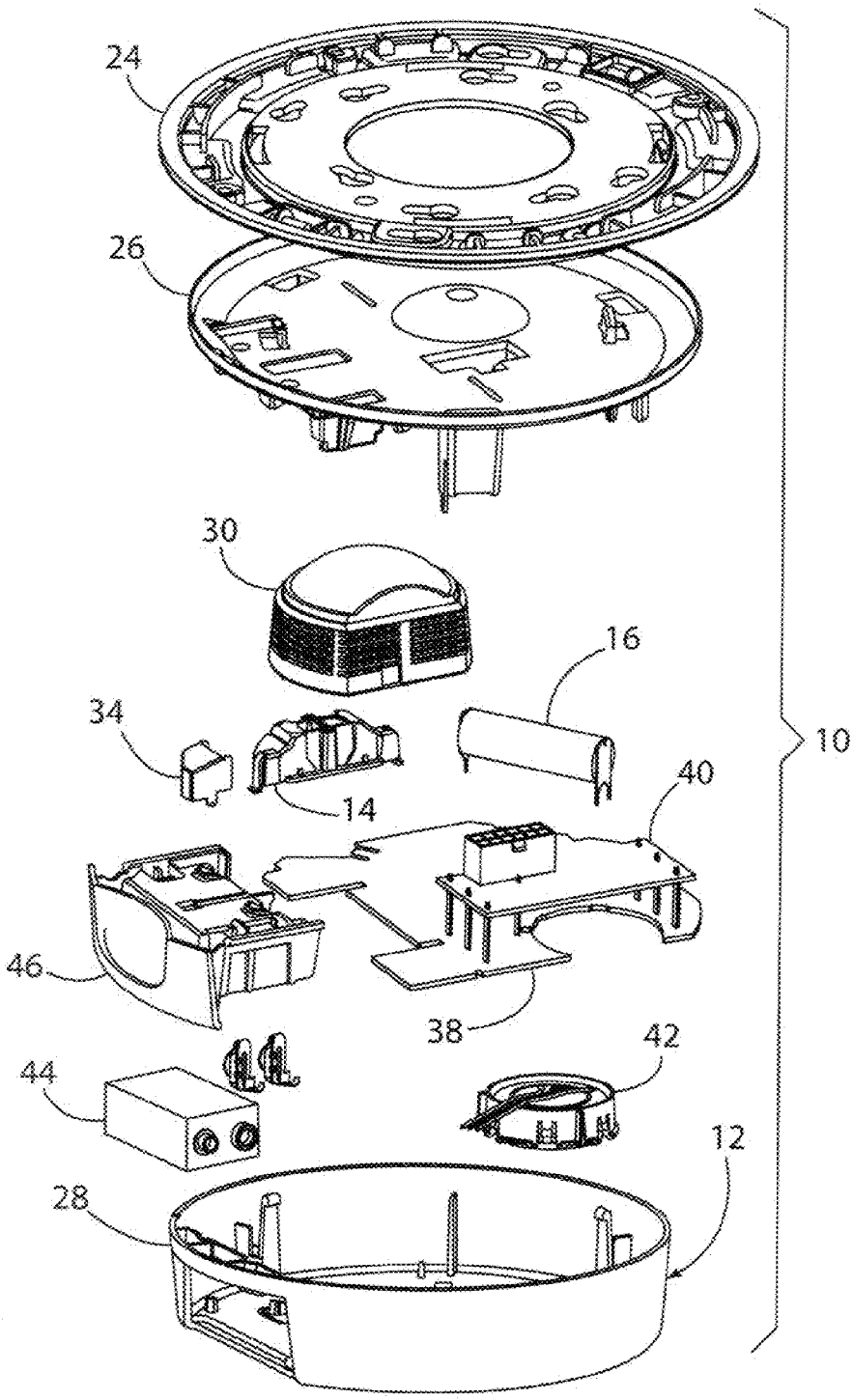
FIG. 3 is an exploded perspective view of a detection device, in accordance with one embodiment of the present invention.
Figure 4:
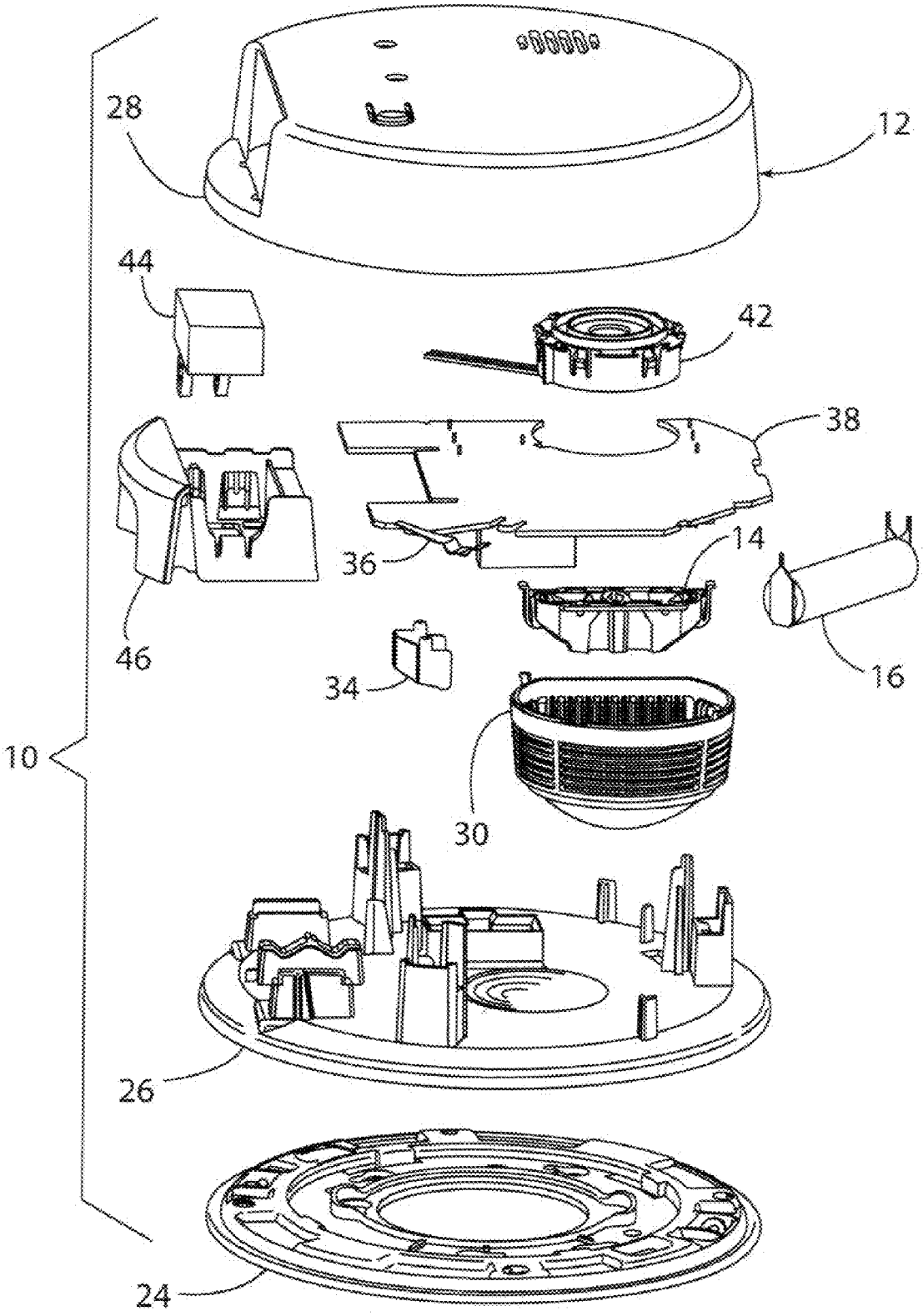
FIG. 4 is an exploded perspective view of a detection device, in accordance with one embodiment of the present invention.

In regards to FIGS. 3 and 4, the detection device 10 can include the housing 12, which has a bracket 24, a base 26, and a cover 28 that are operably connected to one another, according to one embodiment. Typically, the bracket 24 is attached to a building structure, such as, but not limited to, a wall or ceiling. The detection device 10 can further include a cage 30, a shield 34, and a switch element 36 (FIG. 4). Typically, the shield 34 and the switch element 36 are attached to a main circuit board 38, which can also be electrically connected to a power circuit board 40 (FIG. 3). An audible enunciator 42 can be electrically connected to at least one of the main circuit board 38 and the power circuit board 40. For purposes of explanation and not limitation, the audible enunciator 42 can be a horn, an audio speaker, a piezoelectric speaker, the like, or combination thereof. The detection device 10 can also include an internal power source 44, such as, but not limited to, a nine volt (9 V) direct current (DC) power source, which can be installed in the detection device 10 by removing a power source cover 46 and received by hardware circuitry (e.g., the power circuit board 44). Thus, the detection device 10 can be powered by the system power source 23, the internal power source 44, or a combination thereof.

According to one embodiment, the gas particle detected by the second detector device 16 is a carbon monoxide (CO) particle. The audible enunciator 42 can be configured to emit a first audible sound (e.g., a first audible tonal pattern) when the first detector device 14 detects at least one smoke particle, and emits a second audible sound (e.g., a second audible tonal pattern) when the second detector device 16 detects at least one gas particle (e.g., carbon monoxide particle). Thus, the detection device 10 can be a smoke carbon monoxide identification (SCO-ID) module.

Further, the audible enunciator 42 can emit a third audible sound (e.g., a third audible tonal pattern) when the detection device 10 is operating improperly. By way of explanation and not limitation, the detection device 10 may be operating improperly when either the system power source 23, the internal power source 44, or a combination thereof, are no longer supplying electrical power to the electrical components of the detection device 10 when a state of charge of the internal power source 44 is below a threshold value, the like, or combination thereof. In such an embodiment, signals can be communicated to a second detection device 10 that corresponds to the first and second audible sounds, but the detection device 10 does not communicate a signal that corresponds to the third audible sound. As discussed in greater detail below, the audible sound associated with the detection of at least one smoke particle has priority over other audible sounds emitted by the audible enunciator 42, according to one embodiment.

Typically, the plurality of detection devices 10 included in the detection device system 18 are communicatively connected by the tandem electrical conductor 20. In such an embodiment, the detection devices 10 can be substantially synchronized, so that when the smoke particle is detected by the first detector 14, the audible enunciator 42 of substantially all the detection devices 10 in the detection device system 18 that are communicatively connected emit the first audible sound at substantially the same time. Further, the detection devices 10 of the detection device system 18 can be substantially synchronized, so that when the gas particle is detected by the second detector device 16, the audible enunciator 42 of substantially all of the detection devices 10 in the detection device system 18 that are communicatively connected emit the second audible sound at substantially the same time.

The audible sounds emitted by the audible enunciator 42 can be prioritized, such that when a plurality of different particles (e.g., the smoke particle and the gas particle) are detected, the audible enunciator 42 emits the audible sound having a higher prioritization that corresponds to the detected particle, according to one embodiment. By way of explanation and not limitation, the detection of a smoke particle has a higher priority than the detection of a carbon monoxide particle (FIG. 8).

According to one embodiment, the audible enunciator 42 is a piezoelectric speaker that is at least partially enclosed in a housing, wherein the piezoelectric speaker housing is configured to snap-fit to the main circuit board 38. In such an embodiment, the piezoelectric speaker can include an electrical connector that connects or placed into a receptacle on the main circuit board 38 to electrically connect the piezoelectric speaker to other components of the detection device 10. It should be appreciated that the piezoelectric speaker housing snap-fits, or otherwise mechanically connects to other components of the detection device 10, such as, but not limited to, the power circuit board 40. According to one embodiment, the audible enunciator 42 is a single audible enunciator configured to emit each of the audible sounds (e.g., each of the audible tonal patterns), based upon a detected situation, such as, but not limited by at least one smoke particle being detected, at least one gas particle being detected, the detection device 10 not operating properly, the like, or a combination thereof. It should be appreciated that the audible enunciator 42 can be a piezoelectric disc, other suitable piezoelectric device, a suitable speaker device, the like, or a combination thereof.

Additionally or alternatively, at least one operating condition of the detection device 10, such as, but not limited to, altering the sensitivity of one of the first and second databases 14,16 based upon detection of a particle by the other of the first and second detector 14,16. By way of explanation and not limitation, if the second detector 16 detects at least one carbon monoxide particle, then the sensitivity of the first detector 14 can increase. Thus, if a threshold value for determining smoke is present is a first value of parts per million (ppm) when the detection device 10 is operating under normal conditions, the sensitivity of the first detector 14 can be increased, such that the audible enunciator 42 emits an audible source when a second value (that is less than the first value) ppm of smoke particles are detected, when the second detector 16 has detected carbon monoxide.

Further, the detection device 10 detects a smoke particle, a gas particle, or a combination thereof, and communicates such data between the detection devices 10 utilizing the tandem electrical conductor 20, according to one embodiment. In such an embodiment, an operating condition (e.g., sensitivity) of at least one of the detection devices 10 can be altered based upon the data received from another detection device 10 of the detection device system 18. The sensitivity of the first and second detectors 14,16 in a first detection device 10 can be altered based upon the detection of at least one particle by a second detection device 10.

By way of explanation and not limitation, the sensitivity of the first detector 14, the second detector 16, or a combination thereof can be increased or decreased by altering an intensity of light emitted and received within the first and/or second detectors 14,16, as described in greater detail below. Thus, to increase sensitivity, the amount of emitted light is decreased, whereas to increase sensitivity, the amount of emitted light is increased.

Figure 2:
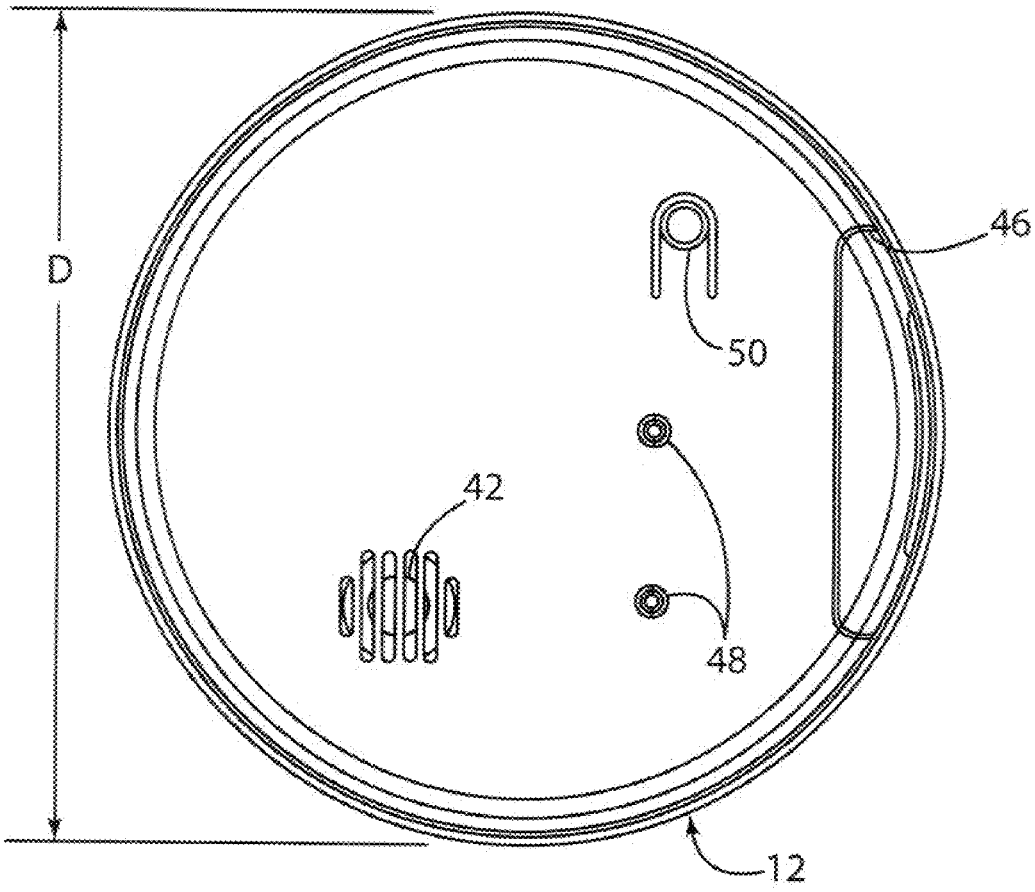
FIG. 2 is a top plan view of a detection device, in accordance with one embodiment of the present invention.

According to one embodiment, the detection device 10 includes at least one indicator device 48. The indicator device 48 can be, but is not limited to, one or more light sources, such as a light emitting diode (LED) that is configured to emit light external to the housing 12, as illustrated in FIGS. 1 and 2. In such an embodiment, the LED can emit light when at least one smoke particle is detected, at least one gas particle is detected, or a combination thereof. Further, the LED can periodically emit light, without detection of either the smoke particle or the gas particle, such that the indicator device 48 is indicating that the detection device 10 is operating properly.

For purposes of explanation and not limitation, the indicator device 48 can include a multi-color LED (e.g., green and red) and a single-color LED (e.g., yellow). The multi-color LED can flash green to indicate the detector device 10 is operating, and can periodically flash red when a particle (e.g., a smoke particle) is detected, when the detector device 10 is not operating properly, or a combination thereof. The single-color LED can flash yellow when a gas particle (e.g., a carbon monoxide particle) is detected. The multi-color LED can flash red in different periodic intervals based upon different operating circumstances. Thus, the multi-color LED can flash red in a first periodic time interval when a smoke particle is detected, and can flash red in a second periodic time interval when the detection device 10 is not operating properly. In such an embodiment, a user of the detector device 10 can determine the difference between the periodic flashings of red, the flashing of red during the second periodic interval, or a combination thereof. When the indicator device 48 is used for diagnostics, a device, such as a personal digital assistant (PDA), can be placed in optical communication with the multi-color LED, so that the device can monitor the periodic interval of the flashing LED, and determine an operating condition of the detection device 10 based upon the periodic interval, according to one embodiment.

Additionally or alternatively, the detection device 10 can include a test button 50 that is positioned to be accessible external of the housing 12 (FIGS. 1 and 2). In such an embodiment, the audible enunciator 42 emits an audible sound (e.g., a trouble chirp) when the detection device 10 is operating improperly. Further, the audible enunciator 42 can emit the audible sound when the detection device 10 is operating improperly, and the test button 50 is actuated (e.g., depressed).

For purposes of explanation and not limitation, a first detection device 10 of the detection device system 18 can be operating improperly (e.g., power not being supplied by the system power source 23 or the internal power source 44, or the internal power source 44 has a low state of charge), and indicate such an improper operating condition utilizing the indicator device 48, emit a trouble chirp utilizing the audible enunciator 42, or a combination thereof. A user of the detection device 10 can then actuate the test button 50 so that the detection device can emit a trouble chirp if the detector had previously emitted the trouble chip and is improperly operating. Thus, in a detection device system 18, when one of the detection devices 10 is operating improperly and emits a trouble chirp, a user can actuate the test button 50 of anyone of the detection devices 10 so that the detection device 10 confirms the detection device 10 was or was not the detection device 10 that emitted the trouble chirp. According to one embodiment, the improperly working detection device 10 does not communicate a signal to the other detection devices 10 of the detection device system 18 via the tandem electrical conductor 20 regarding the improper operating conditions. Typically, the detector device 10 maintains a state that it had detected an improper operating condition and had emitted a trouble chirp (e.g., flag a bit) until a detection device 10 has been reset (e.g., clear flag), such that the power source cover 46 has been opened and closed.

Alternatively, the improperly operating detector device 10 can communicate the improper operating condition to a second detector device 10 of the detection device system 18, wherein both the first and second detector devices 10 indicate an improper operating condition utilizing the indicator 48, emit a trouble chirp via the audible enunciator 42, or a combination thereof. Thus, a user of the detection device system 18 can actuate the test button 50, so that the improperly operating detection device 10 indicates to the user (e.g., via the indicator 48, the audible enunciator 42, or a combination thereof) that the respective detection device 10 is the detection device 10 of the detection device system 18 that is operating improperly. In such an embodiment, a user of the detection device system 18 can be informed that a detector device 10 in a first location (e.g., a furnace room in a building structure) is not working properly, while in a second room (e.g., a bedroom) that is distant from the first room.

According to one embodiment, the detection device 10 includes a test chamber 51 (FIGS. 9A and 9B) enclosed in the housing 12, wherein at least one of the first detector device 14 and second detector device 16 detect the smoke particle and the gas particle, respectively. According to one embodiment, the first detector device 14 is a smoke obscuration detector. Exemplary smoke detector devices are disclosed in commonly assigned U.S. Pat. No. 6,876,305 entitled "COMPACT PARTICLE SENSOR," U.S. Pat. No. 6,225,910 entitled "SMOKE DETECTOR," U.S. Pat. No. 6,326,897 entitled "SMOKE DETECTOR," U.S. Pat. No. 6,653,942, entitled "SMOKE DETECTOR," U.S. Patent Application Publication No. 2008/0018485 entitled "OPTICAL PARTICLE DETECTORS," U.S. Pat. No. 6,556,132 entitled "STROBE CIRCUIT," U.S. Pat. No. 7,167,099 entitled "COMPACT PARTICLE SENSOR," all of which the entire disclosures are hereby incorporated herein by reference. Additionally, an exemplary system is disclosed in commonly assigned U.S. patent application Ser. No. 12/188,740 entitled "NOTIFICATION SYSTEM AND METHOD THEREOF," of which the entire disclosure is hereby incorporated herein by reference.

The cage 30 can be positioned within the housing 12 to substantially enclose the test chamber 51, such that the cage 30 substantially prevents non-smoke, non-gas particles from entering the test chamber 51. According to one embodiment, the cage 30 is a domed cage that is adapted to align within the housing to substantially enclose the test chamber 51. According to an alternate embodiment, the cage 30 is a cubical shape cage that is adapted to align within the housing to substantially enclose the test chamber 51.

In regards to FIGS. 6-8, the tandem signal propagated over the tandem electrical conductor 20 can be similar logic to that of an audible sound signal, according to one embodiment. Further, the audible enunciators 42 of the detection devices 10 in the detection device system 18 can be synchronized when such detector devices 10 are interconnected utilizing the tandem electrical conductor 20, as described in greater detail herein. Additionally, by including a period of time wherein the tandem signal is off or low as part of an alarm protocol that is utilized in the detection device 10 and/or the detection device system 18, the alarms or audible sounds emitted by the audible enunciator 42 can have priority over one another. By way of explanation and not limitation, the audible sound emitted by the audible enunciator 42 when the smoke particle is detected may have priority over the audible sound emitted by the audible enunciator 42 when the gas particle is detected. According to one embodiment, the audible enunciator 42 emits audible sounds that comply with Underwritters Laboratories, Inc. (UL) UL2034 and National Fire Protection Agency (NFPA) 720, when a gas particle is detected, and UL217 and NFPA 72 when a smoke particle is detected.

In regards to FIGS. 6A and 6B, the tandem signal, or audible signal being communicated with the tandem electrical conductor 20, alternating between a high and a low state is generally illustrated in FIG. 6A. According to one embodiment, the audible signal is in a high state ($T_H$) for approximately 0.5 seconds (FIG. 6B), wherein the audible enunciator 42 emits the audible sound that corresponds to a detected smoke particle. The audible signal is then altered to a low state ($T_{L1}$) for approximately 0.5 seconds (FIG. 6B), wherein the audible enunciator 42 does not emit an audible sound. According to one embodiment, the audible enunciator 42 emits the audible sound in a temporal model, wherein the tandem signal alternates between the high state ($T_H$) and the low state ($T_{L1}$) three times, wherein after the third high state ($T_H$), the audible signal is in the low state for a longer period of time ($T_{L2}$) than the other low state ($T_{L1}$), which can be approximately 1.5 seconds (FIG. 6B). It should be appreciated that the high and low times are for exemplary purposes, and that the low state between the high state ($T_H$) of the audible signal can be approximately the same time, according to an alternate embodiment. In such an embodiment, as illustrated in FIGS. 6A and 6B, the audible enunciator 42 can emit an audible noise when a smoke particle is detected, such as "beep" (0.5 seconds), no audible noise (0.5 seconds), "beep" (0.5 seconds), no audible noise (0.5 seconds), "beep" (0.5 seconds), no audible noise (1.5 seconds), and then repeat the pattern.

In regards to FIGS. 7A and 7B, a timing diagram of the audible signal when a gas particle is detected is generally shown in FIG. 7A. According to one embodiment, the audible signal is in a high state ($T_H$), wherein the audible enunciator 42 emits the audible sound that corresponds to a detected gas particle for approximately 0.1 seconds (FIG. 7B), and is then in a low state ($T_{L1}$), wherein the audible enunciator 42 does not emit an audible sound for approximately 0.1 seconds (FIG. 7B). Additionally, the tandem signal can be in a temporal model, wherein after the audible signal is in a high state ($T_H$), the tandem signal is in a low state ($T_{L2}$) that is longer than periods of time for the other low state ($T_{L1}$). The time period ($T_{L2}$) can be, but is not limited to, approximately 5.1 seconds (FIG. 7B). In such an embodiment, as illustrated in FIGS. 7A and 7B, the audible enunciator 42 can emit an audible noise when a gas particle is detected, such as "beep" (0.1 seconds), no audible noise (0.1 seconds), "beep" (0.1 seconds), no audible noise (0.1 seconds), "beep" (0.1 seconds), no audible noise (0.1 seconds), "beep" (0.1 seconds), no audible noise (5.1 seconds), and then repeat the pattern.

According to one embodiment, the audible sound emitted by the audible enunciator 42 can have priority over one another, such that the audible sound that is emitted when a smoke particle is detected has higher priority than the audible sound emitted when a gas particle is detected. As illustrated in FIG. 8, the audible signal is in a high state to emit the audible sound that corresponds to the detection of a gas particle, wherein the audible signal is then altered to a high state for emitting the audible sound for detection of a smoke particle. Thus, once the smoke particle is detected the audible enunciator 42 emits the audible sound that corresponds to the detected smoke particle based upon the received tandem signal, since the audible sound for the detected smoke particle has a higher priority than the audible sound for the detected gas particle.

According to one embodiment, during an alarm condition (e.g., the smoke particle is detected, the gas particle is detected, or a combination thereof), wherein the audible enunciator 42 is to emit an audible sound, the detector device 10 drives the tandem signal propagated along the tandem electrical conductor 20 to a high state ($T_H$). When the detector device 10 is not in an alarm condition (e.g., the smoke particle is not detected, the gas particle is not detected, or a combination thereof), such that the audible enunciator 42 is not emitting an audible sound, the circuitry of the detector device 10 allows the tandem signal to become low. By way of explanation and not limitation, when the tandem signal becomes low, the circuitry of the detector device 10 can pull down at least one resistor, according to one embodiment. Typically, when a detector device 10 detects a particle and is communicating the tandem signal along the tandem electrical conductor 20, the tandem electrical conductor 20 and tandem signal are continuously monitored by other detection devices 10 of the detection device system 18. In such an embodiment, if the detector device 10 is expecting the tandem signal to be low, but the tandem signal is high, the detector device 10 can stop driving the tandem signal low and allow the detector device 10 that is driving the tandem signal high to take over.

When the tandem signal being propagated over the tandem electrical conductor 20 becomes active or high, the detector device that receives the active tandem signal, determines the type of alarm (e.g., the smoke particle is detected, the gas particle is detected, the like, or a combination thereof). The detection device 10 can then activate the audible enunciator 42 to emit the audible sound that corresponds to the received tandem signal and detected particle. Typically, if the tandem signal is low, the audible enunciator 42 is off, and if the tandem signal is high the audible enunciator 42 is on. According to one embodiment, when the detection devices 10 include similar logic, such that when the tandem signal is low the audible enunciator 42 is off and when the tandem signal is high, the audible enunciator 42 is on, the audible enunciators 42 of the detection devices 10 in the detection device system 18 are synchronized to be on and off at the same time. The detection device 10 can also drive the audible enunciator 42 according to the condition detected.

According to an alternate embodiment, the detection device system 18 can include the detection device 10 that includes at least the first detection device 14 and the second detector device 16, a detection device 10A that includes the first detector device 14, and a detection device 10B that includes the second detector device 16 (FIG. 5). In such an embodiment, the detection device 10A is only configured to detect smoke particles with the first detection device 14, and the detection device 10B is only configured to detect gas particles with the second detection device 16. Additionally, the detection devices 10A and 10B can be configured to emit the corresponding audible sound using the audible enunciator 42 when the respective detection device 14,16 detects the respective particle. Further, when another detection device 10,10A,10B in the detection device system 18 detects a particle and communicates or drives the tandem signal utilizing the tandem electrical conductor 20, that the detection device 10A,10B is not configured to detect the detectors 10,10A,10B can emit the corresponding audible sound utilizing the audible enunciator 42. By way of explanation and not limitation, the detection device 10A can emit the corresponding audible sound utilizing the audible enunciator 42 for detection of the gas particle when another detection device 10,10B of the detection device system 18 detects gas particles and communicates such a signal with the tandem electrical conductor 20, even though the detection device 10A is not configured to detect gas particles. Thus, the detection device 10A can be configured to detect smoke particles and be in a bedroom of a residential building, and can then emit the audible sound for detection of gas particles detected by detection device 10B, when a detection device 10B in the basement of the residential building, according to one embodiment. Alternatively, the detection device 10,10A,10B can be configured to only emit the audible noise for which they are configured to detect, such that if a smoke particle is detected by detection device 10 and communicates a corresponding signal along the tandem electrical conductor, the detection device 10B will disregard the signal.

Additionally or alternatively, the detection devices 10,10A,10B can communicate other data utilizing the tandem electrical conductor 20, which can be received and used to alter operating conditions of the detection device 10,10A, 10B. For purposes of explanation and not limitation, if a detection device 10,10A,10B that is configured to detect the gas particle, detects such particles, the detection device 10,10B can communicate a signal utilizing the tandem electrical conductor 20 to other detection devices 10,10A so that such detection devices 10,10A can be more sensitive to smoke particles. According to one embodiment, alternating the operating conditions of the detection device 10,10A,10B, the detection devices 10,10A,10B can be more sensitive to allow for early response to detection of particles.

Figure 9A:
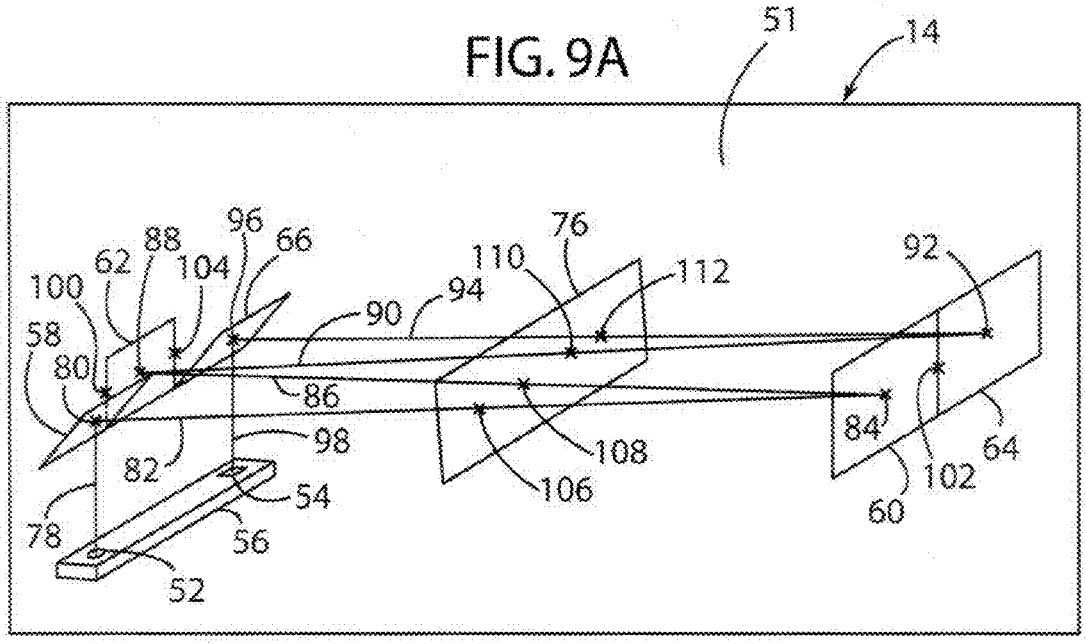
FIG. 9A is a schematic diagram of optical elements in a detection device, in accordance with one embodiment of the present invention.
Figure 9B:
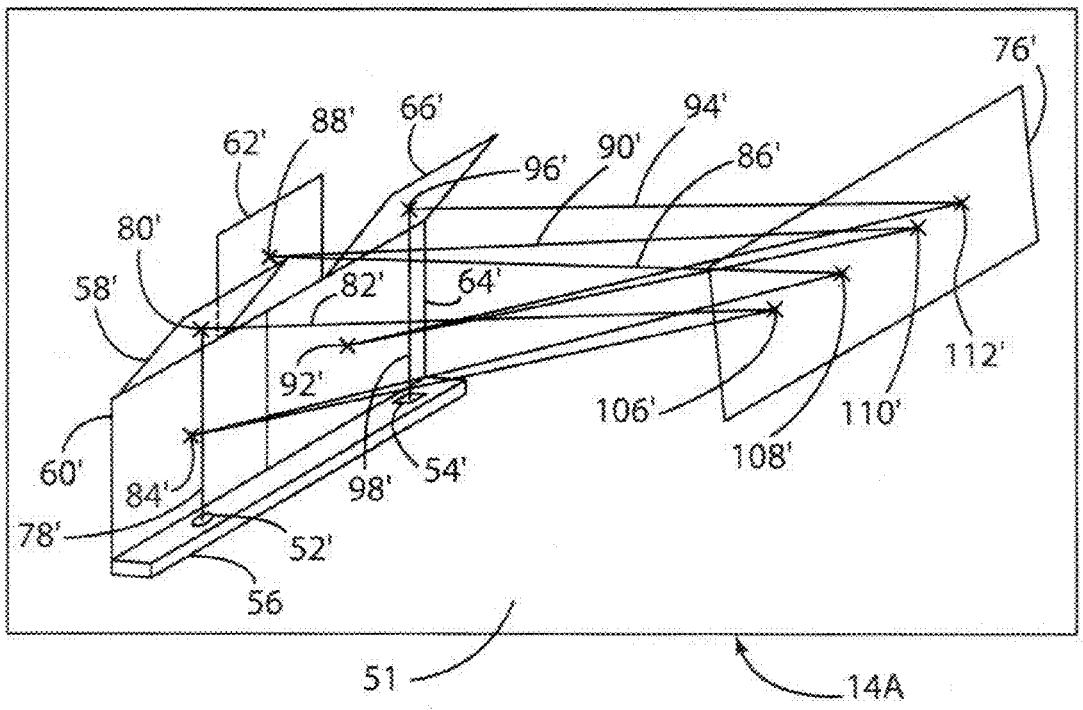
FIG. 9B is a schematic diagram of optical elements in a detection device, in accordance with an alternate embodiment of the present invention.

In regards to FIGS. 9A and 9B, the first detector device 14, which can be configured to detect a smoke particle, can include a light source 52, a detecting element 54, and a plurality of reflectors, according to one embodiment. The light source 52 can be configured to emit a light, and the receiver can be in optical communication with the emitter and configured to receive at least a portion of the light emitted by the light source 52. Typically, the plurality of reflectors are in optical communication between the light source 52 and the detecting element 54, and positioned to form an optical path within the housing 12, as described in greater detail herein.

According to one embodiment, a class of smoke detectors uses the optical properties of a space filled with a representative sample of the smoke to make a determination of when to issue an alarm to alert occupants of the monitored space of a potential fire hazard. Many variants of these detectors have been used. Some use various colors of light and some are based on the light scattering properties, light reflecting properties, light absorbing properties, or some combination of these properties of smoke. Some detectors primarily detect and respond to light which is scattered or reflected by smoke particles in the air and others primarily detect the attenuation of light due to the attenuation of a beam of light traveling over a significant distance through a sample of the smoke. The attenuation may be due in part to direct attenuation of the light beam by absorption of the rays of light and also in part to scattering of the rays in the beam so that they no longer reach a sensor or receiver. The optical sensors are mostly of the type which detect scattering due to smoke particles in the air. Such detectors respond well to smoke from smoldering fires, but can be limited with respect to smoke from certain kinds of faster burning fires.

Detectors based on the obscuration principle perform better for smoke from faster burning fires. The challenge with obscuration detectors is that the attenuation at the alarm threshold is generally expressed in percent per foot and an alarm threshold may, for example, be set to alarm when the attenuation of the light reaches two and one half percent per foot (2.5%/ft) making it difficult to achieve a combination of path length, readout stability, and no smoke reference level accuracy to provide reliable operation. The total obscuration increases in approximate proportion to the length of the path so a longer path increases the alarm threshold signal but is difficult to provide in an enclosure of limited size. The alarm threshold is established in relation to a reference level established typically before a smoke level began to build. Light output of the emitter is temperature dependent as is sensitivity of the detector. The light measurement is also sensitive to mechanical changes in the optical arrangement which may occur because of the detector being subject to being bumped or to temperature changes and to the light attenuating effects of dust or films which accumulate on optical surfaces. With increased path length, maintaining enough light in the beam to minimize interference from ambient light and provision of a system which minimizes or eliminates the need for custom alignment of the beam to properly illuminate the sensor are all important design features.

In a one embodiment, multiple reflecting lens elements 58, 60, 62, 64, and 66 are each covered by a reflective coating, and are arranged as an array with several discrete lens elements in close proximity to one another in a unitary part. It should be appreciated that at least one reflecting lens element can be utilized, and that the description contained herein reflecting lens elements 58, 60, 62, 64, and 66, for purposes of explanation and not limitation. This array of reflecting lens elements 58, 60, 62, 64, and 66 can be used in combination with a planar reflecting surface to fold the light beam so that a first reflecting lens 58 in the array directs light via a reflection from the planar reflecting surface to a second reflecting lens 60 in the array and the second reflecting lens 60 in the array directs light via a reflection from the planar reflecting surface to a third reflecting lens 62 in the array and this sequence typically continues for each active reflecting lens 66 in the array until the final active reflecting lens 66 in the array directs light to a light level measuring device or detecting element 54.

Referring to FIG. 9A, an array of five reflecting lens surfaces 58, 60, 62, 64, and 66 are configured to capture an appreciable proportion of the light which emanates from light source 52, direct it in an elongated path between the reflecting lens 58, 60, 62, 64, and 66, and direct an appreciable portion of it to a light detecting element 54. According to one embodiment, the light source 52 and the detecting element 54 can be attached to a base structure 56. Additionally, at least a portion of the plurality of reflectors 58, 60, 62, 64, 66 can also be attached to the base structure 56. In one exemplary embodiment, as illustrated in FIG. 9A, only the central ray is depicted and reference surface 76 has no direct function in FIG. 9A except to depict the relation with FIG. 9B, wherein reference surface 76 is replaced by reflecting surface 76' as will be explained in relation to FIG. 9B. Ray 78 emanates from light source 52 (e.g., a LED) and is reflected from point 80 of reflecting lens element 58, where it continues as ray 82, which is reflected from point 84 of reflecting lens element 60, where it continues as ray 86, which is reflected from point 88 of reflecting lens element 62, where it continues as ray 90, which is reflected from point 92 of reflecting lens element 64, where it continues as ray 94, which is reflected from point 96 of reflecting lens element 66, where it continues as ray 98, which is received by the detecting element 54 (e.g., a photo-sensing element).

Reflecting lens element 58 can serve generally to reflect light ray 78 emanating from light source 52 (e.g., a LED), which strike it so that they strike the surface of reflecting lens element 60. Reflecting lens element 60 can serve generally to reflect light ray 82 reaching it from the surface of lens element 58, so that they strike the surface of reflecting lens element 62. Reflecting lens element 62 serves generally to reflect light ray 86 reaching it from the surface of lens element 60, so that they strike the surface of reflecting lens element 64. Reflecting lens element 64 serves generally to reflect light ray 90 reaching it from the surface of lens element 62, so that they strike the surface of reflecting lens element 66. Reflecting lens element 66 serves generally to reflect light ray 94 reaching it from the surface of lens element 64, so that they strike the surface of the detecting element 54 (e.g., a sensing element).

To perform the functions listed above, the reflecting surfaces of lens elements 58 and 66 are approximately ellipsoids of revolution formed as portions of surfaces, each of which is generated by revolving an ellipse about its major axis and surfaces 60, 62, and 64 are approximately spherical surfaces. For example, reflecting lens surface 58 may be generated as a portion of the surface generated by constructing an ellipse having one of its two foci at the center of the emitting surface of the light source 52 (e.g., a LED), and the other of its two foci at a center 84 of reflecting lens surface 60 and with minor and major diameters of the ellipse chosen so that the ellipse passes thorough (or near to) point 80 of reflecting lens surface 58 and revolving it about its major diameter. Reflecting lens surface 66 may be similarly formed generated as a portion of the surface generated by constructing an ellipse having one of its two foci at the center of the active receiving surface of the detecting element 54, and the other of its two foci at the center 92 of reflecting lens surface 64 and with minor and major diameters chosen so that the ellipse passes through (or near to) point 96 of reflecting lens surface 66, and revolving it about its major diameter. Lens surface 60 may be a spherical surface with its center 100 approximately at the midpoint between the center 80 of lens surface 58 and the center 88 of lens surface 62. Lens surface 62 may be a spherical surface with a center 102 approximately at the midpoint between the center 84 of lens surface 60 and the center 92 of lens surface 64. Lens surface 64 may be a spherical surface with a center 104 approximately at the midpoint between the center 88 of lens surface 62 and the center 96 of lens surface 66.

According to one embodiment, light source 52 can be selected so that the diameter of its emitting area is relatively small and to select the distance 78 from light source 52 to the first lens 58 which receives light from the light source 52 so that it is substantially less than the distance 82 of the second lens 60 to which the light is directed from the first lens 58. For example, the distance 78 from the light source 52 to the center 80 of the first reflecting lens element 58 may be nominally in the range of one twentieth (0.05) to one fourth (0.25) of the distance 82 from the center 80 of first reflecting lens element 58 to the center 84 of second reflecting lens element 60. With the light source 52 closer to reflecting lens element 58, rays from the light source 52 emitted from a larger cone angle (larger numerical aperture) strike the reflecting area of reflecting lens element 58 increasing the amount of light from the light source 52, which is directed into the detection beam of the detecting element 54 (e.g., an obscuration sensor). The diameter of the region on reflecting lens element 60 to which rays from light source 52 are directed by reflecting lens element 58 relative to the diameter of the light emitting region of light source 52 increases in approximate proportion to the ratio of the distance 82 of the second lens from the first lens 58 relative to the distance 78 of the light source 52 from the first lens 58. The distance 78 relative to the distance 82 can be chosen so that light from the light source 52 projected by first lens 58 toward second lens 60 will cover an appreciable proportion of the area of second lens 60 and at the same time that an appreciable proportion of this light will fall on the surface of lens 60. Lens 60 projects light received from lens 58 into an area, which is approximately the mirror image of the outline shape of lens 58 as viewed from the center 84 of lens 60. The system as depicted, provides for reflecting lens element 58, which serves the combined functions of directing light received from the light source 52 and projecting it to a more distant receiving area over a path that is approximately perpendicular to the general direction from which the light was received. Thus, the outline shape of lens 62 can approximately match the mirror imaged outline shape of lens 58 as projected by lens 60 so that its surface also will be approximately covered by light coming from lens 58. Following similar reasoning, the outline shape of lens 66 as viewed from the center 92 of lens 64 should approximately match the approximately mirror image outline shape of lens 62 as projected by lens 64. This links the outline shapes and orientations of lens elements 58, 62, and 66. The lensed outline shapes indicated can be used, but are not required, to practice the invention. Additionally, molded material may be added to join the reflecting surfaces into a rigid unitary structure for which the outline shapes of each reflecting lens is in close proximity to its neighboring lens and all nonplanar lenses in the array are in close proximity to another lens in the array. Lens 62 projects light received from lens 60 into an area having an outline shape which is approximately the mirror image of the outline shape of lens 60 as viewed from the center 88 of lens 62. Thus, the outline shape of lens 64 can approximately match the mirror imaged outline shape of lens 60 as projected by lens 62 so that its surface also will be approximately covered by light coming from lens 60.

In application, the light source 52 (e.g., a LED) with an integral, relatively small diameter lens can be used, which concentrates light emitted from the light source 52 into a relatively small beam angle. Then a reasonable percentage of the light may be focused so that it strikes the relatively close spaced reflecting lens surface 58. A lens may optionally be employed for the light sensor or detecting element 54 or a larger area photodiode may be used. Texturing or some other diffusing technique can be used for lens surface 66 to moderately diffuse the light projected onto the light source 52. Such diffusion may reduce the change in the reading of the beam intensity due to minor changes in lens alignment in the optical path.

In FIGS. 9A and 9B, the arrangement can be generally symmetrical about the center of the path at 88, according to one embodiment. The path 98 from reflecting lens element 66 to the detecting element 54 is much shorter than path 94 from reflecting lens element 64 to reflecting lens element 66. For reasons very similar to those explained for the magnify effect in projecting light from the light source 52 onto reflecting mirror element 60, following this path in reverse, light from larger area reflecting lens 64 is projected onto a much smaller area at the detecting element 54, so that with the lens design detailed in the exemplary embodiment, an appreciable proportion of the light in the projected beam used for the obscuration measurement which strikes lens surface 64 is projected into a much smaller area where it is projected onto the detecting element 54.

The light intensity in the smaller area into which the light is projected onto the detecting element 54 increases in approximate proportion to the ratio of the area illuminated by the beam at reflecting lens 64 to the area into which this pattern of illumination is projected at the detecting element 54. The relatively small area at the light source 52 projected onto intermediate lens surface 60 and the relatively small area the detecting element 54 onto which light is projected from intermediate lens surface 64 provide entrance and exit areas over which light is received at the detecting element 54 and projected at the light source 52. These entrance and exit areas are well delineated by the projections of related intermediate lens surfaces and their position relative to the lens structure may be tightly controlled in the design and molding of the lens array enabling projection of a light beam over and extended path free of the need for special alignment steps. The system as depicted, provides for reflecting lens element 58, which serves the combined functions of directing light received from the light source 52 and projecting it to a more distant receiving area over a path which is approximately perpendicular to the general direction from which the light was received from light source 52. The system as depicted also provides for reflecting lens element 66, which serves the combined functions of directing light received from the more distant lens surface 64 and projecting it to a smaller, closer spaced receiving area the detecting element 54 over a path that is approximately perpendicular to the general direction from which the light was received from lens 64. The system also includes lens element 88, which relays light projected onto first intermediate lens surface 60 to intermediate lens surface 64. Lens surfaces 60 and 64 each serve generally to direct light rays projected to them by a preceding lens in the optical path so that an appreciable proportion of this light is projected onto a succeeding lens in the optical path.

Reference surface 76 is placed approximately mid-way between the lens group which contains reflecting lens elements 58, 62, and 66, and the lens group which contains reflecting lens elements 60 and 64. The central rays 82, 86, 90, and 94 intersect this reference surface at points 106, 108, 110, and 112, respectively. In FIG. 9B, the five lens elements described in FIG. 9A are retained with lens elements 60 and 64 being repositioned as elements 60' and 64', respectively; and, reference surface 76 is replaced with plane mirror 76' so that the four light beams represented by central rays 106, 108,110 and 112 are reflected back toward and just below the group of three reflecting lenses 58, 62, and 66. In FIG. 9B, like reference characters represent like elements. The reflecting lens elements 60 and 64 are rotated to continue to generally face mirror 106' and become lens elements 60' and 64'. With the introduction of mirror surface 106', the beam is effectively folded nearly back on itself so that the group of reflecting lens elements having elements 60' and 64', is positioned just below and approximately adjacent to the group of reflecting lens elements having elements 58', 62', and 66'. With the configuration depicted in FIG. 9B, the array of reflecting mirrors may be molded in a common part 14A and this assembly may include features to key it to a printed circuit board on which the light source 52' and the detecting element 54' may be mounted and registered in their proper positions. A structure to hold and position the array of reflecting lens elements 14A and the planar mirror 76' can be configured to maintain accurate positioning of the mirror 76' relative to array 14A and can be configured to also include a bug screen and features to provide selective light shielding and to enhance airflow patterns provide adequate response times to smoke buildup.

The optical assembly of FIG. 9B preserves nearly all of the features described in the optical system of FIG. 9A, while approximately halving the longer dimension of the space needed to provide a given beam length and also providing for a structure in which all of the substantially non-planar lens elements are arranged in a compact array which may be conveniently provided as a unitary molded part.

Exemplary emitters are disclosed in commonly assigned U.S. Pat. No. 5,803,579 entitled "ILLUMINATOR ASSEMBLY INCORPORATING LIGHT EMITTING DIODES," U.S. Pat. No. 6,335,548 entitled "SEMICONDUCTOR RADIATION EMITTER PACKAGE," U.S. Pat. No. 6,521,916 entitled "RADIATION EMITTER DEVICE HAVING AN ENCAPSULANT WITH DIFFERENT ZONES OF THERMAL CONDUCTIVITY," U.S. Pat. No. 6,550,949 entitled "SYSTEMS AND COMPONENTS FOR ENHANCING REAR VISION FROM A VEHICLE," U.S. Patent Application Publication No. 2003/0156425 entitled "LIGHT EMITTING ASSEMBLY," U.S. Patent Application Publication No. 2004/0239243 entitled "LIGHT EMITTING ASSEMBLY," all of which the entire disclosures are hereby incorporated herein by reference. Exemplary receivers are disclosed in commonly assigned U.S. Pat. No. 6,313,457 entitled "MOISTURE DETECTING SYSTEM USING SEMICONDUCTOR LIGHT SENSOR WITH INTEGRAL CHARGE COLLECTION," U.S. Pat. No. 6,359,274 entitled "PHOTODIODE LIGHT SENSOR," U.S. Pat. No. 6,469,291 entitled "MOISTURE DETECTING SYSTEM USING SEMICONDUCTOR LIGHT SENSOR WITH INTEGRAL CHARGE COLLECTION," U.S. Pat. No. 6,679,608 entitled "SENSOR DEVICE HAVING AN INTEGRAL ANAMORPHIC LENS," and U.S. Pat. No. 6,831,268 entitled "SENSOR CONFIGURATION FOR SUBSTANTIAL SPACING FROM A SMALL APERTURE," all of which the entire disclosures are hereby incorporated herein by reference.

According to one embodiment, the light source 52 can emit light at a plurality of wavelengths. In such an embodiment, the light emitted at different wavelengths can be emitted at different angles with respect to the reflectors 58, 60, 62, 64, 66, and 70, the detecting element 54, or a combination thereof. The light source 52 can include multiple light emitting devices, such as, but not limited to, a first light emitting device emitting light at a first wavelength and a first angle, and a second light emitting device emitting light at a second wavelength and a second angle.

Advantageously, the detector device 10 can detect both a smoke particle and a gas particle, and be included in a detection device system 18, wherein data is communicated between the detection devices 10,10A,10B utilizing a tandem electrical conductor 20. Thus, the detection devices 10,10A, 10B can be substantially synchronized, alter operating conditions of the detection device 10,10A,10B based upon the received data, or a combination thereof. Additionally, a detection device 10 can include optical components including the light source 52, the detecting element 54, and the plurality of reflectors 58, 60, 62, 64, 66 to form an optical path that is greater than a largest dimension in the housing 12 to increase the accuracy of the detection of smoke particles. It should be appreciated that there may be additional or alternative advantageous based upon the detection device 10 and detection device system 18. It should further be appreciated that the above components can be combined in additional or alternative ways that are not explicitly described herein.

Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A detection device comprising:

a housing;

a first detector device configured to detect at least one smoke particle;

a second detector device configured to detect at least one gas particle, wherein said first detector device and said second detector device are substantially enclosed in said housing;

an audible enunciator configured to emit a first audible sound when said first detector device detects at least one smoke particle, and a second audible sound when said second detector device detects at least one gas particle;

a test button, wherein said audible enunciator emits a third audible sound when said detection device is operating improperly and said test button is actuated;

a receptacle configured to receive a conductor that communicatively connects the detection device with a second detection device, wherein signals corresponding to said first and second audible sounds are communicated to said second detector, while a signal corresponding to said third audible sound is not communicated to said second detector; and wherein said first audible sound, second audible sound and third audible sound each differ.

2. The detection device of claim 1, wherein said gas particle detected by said second detector device is a carbon monoxide particle.

3. The detection device of claim 1, wherein said audible enunciator is a single audible enunciator, such that said single audible enunciator is configured to emit each of said first, second, and third audible sounds.

4. The detection device of claim 1, that is communicatively connected to at least a second detection device in a detection device system.

5. The detection device of claim 4, wherein said detection devices of said detection device system are substantially synchronized, such that when said smoke particle is detected by said first detector device of said detection device in said detection device system, said audible enunciator of said detection devices that are communicatively connected emit said first audible sound at substantially the same time.

6. The detection device of claim 4, wherein said detection devices of said detection device system are substantially synchronized, such that when said gas particle is detected by said second detector device of said detection device in said detection device system, said audible enunciator of said detection devices communicatively connected emit said second audible sound at substantially the same time.

7. The detection device of claim 1 that is communicatively connected to at least said second detection device in a detection device system, wherein said conductor for said communicative connection is a tandem electrical conductor.

8. The detection device of claim 7, wherein a tandem signal is communicated across said tandem electrical conductor, such that substantially all said detection devices of said detection device system that are communicatively connected are substantially synchronized.

9. The detection device of claim 7, wherein data is communicated between said detection devices of said detection device system utilizing said tandem electrical conductor.

10. The detection device of claim 1, wherein a sensitivity of one of said first and second detector devices is altered based upon detection of at least one particle by the other of said first and second detector devices.

11. The detection device of claim 1, wherein said audible enunciator is configured to emit a plurality of audible sounds based upon detection of at least one of said smoke particle and said gas particle so that at least a portion of said plurality of audible sounds are prioritized, such that when said smoke and gas particles are detected, said audible enunciator emits said audible sound having a higher prioritization.

12. The device of claim 11, wherein said audible sound that corresponds to detection of said smoke particle has a higher prioritization than said audible sound that corresponds to detection of said gas particle.

13. The detection device of claim 1 further comprising an indicator device configured to indicate an operating condition of a detection device.

14. The detection device of claim 13, wherein said indicator device is a light emitting diode (LED) configured to emit light external to said housing.

15. The detection device of claim 14, wherein said LED emits said light when at least one of said smoke particle and said gas particle are detected.

16. The detection device of claim 13, wherein said indicator device at least periodically emits light, such that said emitted light is monitored for diagnostics of said operating condition.

17. The detection device of claim 1, further comprising a test chamber enclosed in said housing, wherein said first and second detector devices detect said smoke particle and said gas particle, respectively, in said test chamber.

18. The detection device of claim 17, further comprising a cage enclosed in said housing, wherein said cage substantially encloses said test chamber to substantially prevent non-smoke, non-gas particles from entering said test chamber.

19. The detection device of claim 1, wherein said first detector device is a smoke obscuration detector.

20. The detection device of claim 1, further comprising hardware circuitry configured to receive electrical power having a voltage potential of one of one hundred twenty volts (120 V) and nine volts (9 V).

21. A detection device comprising:

a housing;

a first detector device configured to detect at least one smoke particle;

a second detector device configured to detect at least one gas particle, wherein said first detector device and said second detector device are substantially enclosed in said housing;

an indicator device configured to indicate an operating condition of a detection device, wherein said indicator device at least periodically emits light that is monitored for diagnostics of said operating condition; and wherein an audible enunciator is used for emitting an audible sound when said detection device is operating improperly and a test button is actuated.

22. The detection device of claim 21, wherein said indicator device is a light emitting diode (LED) configured to emit light external to said housing.

23. The detection device of claim 22, wherein said LED emits said light when at least one of said smoke particle and said gas particle are detected.

24. The detection device of claim 21, wherein said gas particle detected by said second detector device is a carbon monoxide particle.

25. The detection device of claim 21 further comprising an audible enunciator configured to emit a first audible sound when said first detector device detects said smoke particle, and emit a second audible sound when said second detector device detects said gas particle.

26. The detection device of claim 21 that is communicatively connected to at least a second detection device in a detection device system, wherein said communicative connection is a tandem electrical conductor.

27. The detection device of claim 21, wherein a sensitivity of one of said first and second detector devices is altered based upon detection of at least one particle by the other of said first and second detector devices.

28. A detection device comprising:

a housing;

a first detector device configured to detect at least one smoke particle, wherein said first detector device comprises:

at least one light source;

a plurality of reflectors in optical communication with said at least one light source; and a detecting element in optical communication with said at least one light source and said plurality of reflectors;

wherein said first detector device is configured to at least one of:

said at least one light source emits light at a plurality of wavelengths; and light emitted by said at least one light source is emitted at different angles; and an audible enunciator configured to emit a first audible sound when said first detector device detects at least one smoke particle.

* * * * *